US006675510B2

(12) United States Patent
Ocampo

(10) Patent No.: US 6,675,510 B2
(45) Date of Patent: Jan. 13, 2004

(54) FABRIC-GRIPPING/STRETCHING SYSTEM

(76) Inventor: Horacio M. Ocampo, 1700 W. 135th St., Gardena, CA (US) 90249

( * ) Notice: Subject to any disclaimer, the term of this patent is extended or adjusted under 35 U.S.C. 154(b) by 0 days.

(21) Appl. No.: 10/139,809

(22) Filed: May 7, 2002

(65) Prior Publication Data

US 2003/0208934 A1 Nov. 13, 2003

(51) Int. Cl.[7] ..... D06C 3/08
(52) U.S. Cl. ..... 38/102.91
(58) Field of Search ..... 38/102.91, 102.2; 269/47, 86, 89, 104; 160/371, 374.1, 378, 380, 383, 389, 391, 395, 398, 399, 402, 403, 404

(56) References Cited

U.S. PATENT DOCUMENTS

| | | | | | |
|---|---|---|---|---|---|
| 1,749,223 | A | * | 3/1930 | Mott | 160/384 |
| 3,507,062 | A | * | 4/1970 | Moyer | 38/102.91 |
| 4,006,771 | A | * | 2/1977 | Spurkel | 160/378 |
| 5,141,046 | A | * | 8/1992 | Duncan | 160/379 |
| 6,192,611 | B1 | * | 2/2001 | Molla | 40/604 |

* cited by examiner

*Primary Examiner*—Ismael Izaguirre
(74) *Attorney, Agent, or Firm*—J. E. McTaggart

(57) ABSTRACT

For gripping and stretching fabric such as art canvas, a system of specially-shaped gripping members are attached to the material in line along each edge in a manner that in co-operative engagement with the frame via special frame channels, facilitates two-dimensional stretching and mounting as well as subsequent dismounting of the material from the frame, rolling up for shipping or storage, and reassembly and re-mounting onto the frame. The gripping members slide into the frame channels which then engage a fixed or adjustable frame; optionally the fabric may be stretched around the frame perimeter. The gripping members are attached in pairs: one on each sides of the fabric, arranged in line near the edge of the fabric and are made to slide freely in the frame channels to enable two-dimensional stretching of the fabric. The members of each pair are permanently attached together by wire staples or thread, gripping the fabric between interfacing surfaces which may be shaped to enhance gripping. Optimal spacing between pairs provides good gripping and yet allows the fabric to be removed from the frame channels and rolled up for transportation and shipping purposes, and subsequently easily re-stretched onto the frame. The gripping members may be molded in multiples joined together by curved flexible strips that accommodate two-dimensional fabric stretching and automatically set the optimal spacing.

17 Claims, 4 Drawing Sheets

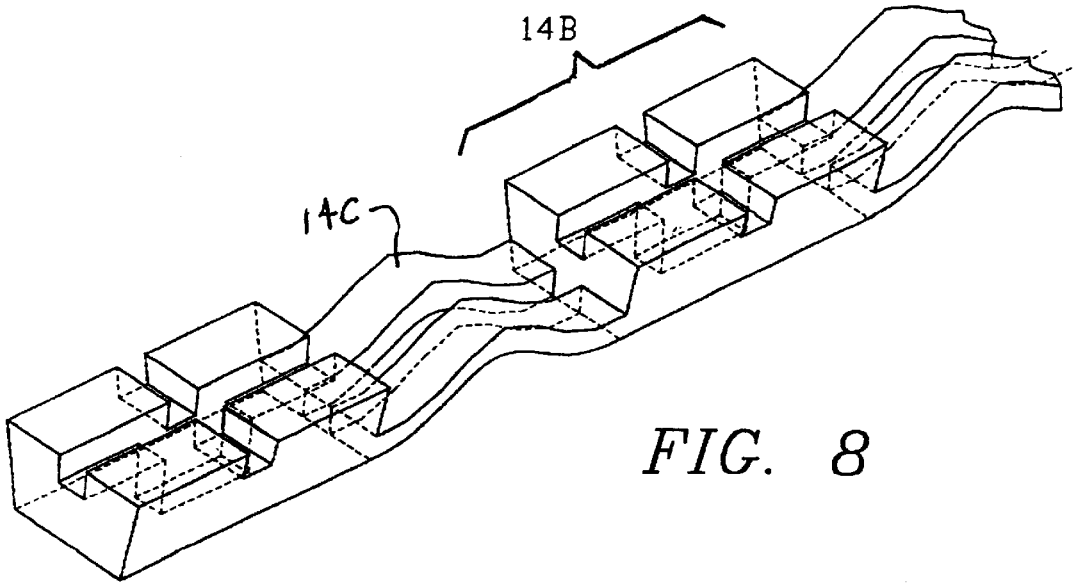
FIG. 8
FIG. 9
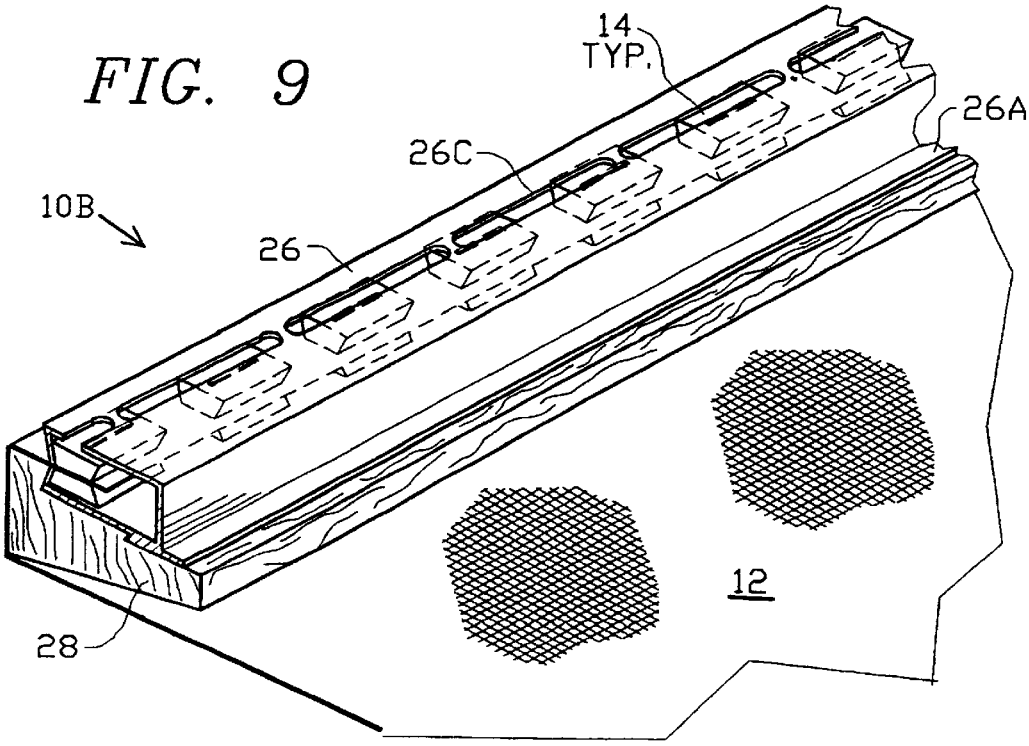

FABRIC-GRIPPING/STRETCHING SYSTEM

FIELD OF THE INVENTION

The present invention relates to the field of fabric stretching and more particularly it relates to an edge-gripping system for stretching of fabric, especially art canvas, that is customarily stretched on a mounting frame with the fabric wrapped around the perimeter. The invention is directed to gripping the fabric in a manner that enables stretching along the gripped edges and thus enhances two-dimensional overall stretching both in original fabric mounting and later removal of the fabric from the frame for shipping and/or storage in rolled form, including subsequent re-mounting of the fabric, where the invention enables the fabric to be once more stretched onto the mounting frame in a satisfactory manner without degrading the fabric strength and integrity.

The term "fabric" as used herein is intended to include sheet materials of various types that may be deployed in artwork, billboards, posters and the like, particularly where the fabric is mounted by stretching it around the perimeter of the mounting frame as commonly practiced with canvas for paintings.

BACKGROUND OF THE INVENTION

It is often required to stretch a sheet of fabric in two perpendicular dimensions either for pre-conditioning and/or priming or for stretching the fabric into place on a mounting frame such as the backboard or mounting frame of an art painting or an outdoor billboard. In many instances, at some time after the initial stretch-mounting there may be need for removal and possible re-deployment of the fabric: in known fabric-gripping systems, such rework is inherently troublesome and difficult, and often imposes a serious risk of damaging or destroying a work of art.

Large works of art stretched onto frames are very costly to ship and may even exceed the dimensional limits of the shipping company. It would be highly desirable to have a mounting system that enables uniform and efficient initial gripping and stretching of the fabric onto a frame, and that, unlike conventional gripping practice, allows the fabric to be conveniently removed at a later time, for example, to be rolled up for shipping or storing purposes to be later re-mounted to the frame.

For inexpensive artwork, the fabric, typically canvas, is traditionally gripped and stretched by hand over a fixed wooden frame and fastened to the wood frame with tacks, staples or adhesives while somehow being held under tension. Since the gripping, stretching and fastening must all be accomplished simultaneously, this requires a high level of skill that must be learned from trial and error experience; therefore the results vary from one operator to another and it is not unusual to encounter corner wrinkles in the finished products that are difficult to remedy, or even worse, corner tearing damage that causes major waste of raw fabric material and destruction of finished artwork.

In the conventional low-cost manner of fastening with tacks, staples or adhesives, there is generally no consideration given to later adjustment or removal, which, if required, is an extremely laborious and unsatisfactory operation. In one approach to mitigate this problem, staples are driven through a strip of material that is installed initially for the purpose of facilitating possible future removal of the staples if necessary; however each time this is done and the canvas is re-mounted, the fabric edge becomes further weakened by being punctured with a new set of staple holes in addition to the old unused set(s) of staple holes.

Stretching a rectangular sheet generally requires gripping the material along four edges and then applying stretching force in both lateral and longitudinal directions simultaneously; any uniform overall stretching that occurs involves expansion along each of the four edges, so the method of gripping must be able to expand accordingly to accommodate the edge stretching in order to avoid uneven stresses, distortion, corner wrinkles and tearing. Optimal stretching requires complex variations in the relative amount of tensioning force applied in the central regions of each edge versus the force applied near the corners.

In seeking to automate or at least mechanize the stretching, the method of gripping or clamping along each edge requires special attention to allow for the two-dimensional expansion. Anything added for thickening the edges of the material for gripping purposes must be able to expand along with the material, e.g. if a hem is sewn, even the thread stitches must be sufficiently expandable. Wedges, jamming strips, etc., whether inserted into a hem or merely forced into a groove with the fabric tend to act in a manner that constrains stretching along the edges and thus harms the uniformity and quality of overall stretching.

For mounting large and/or expensive canvas works there are available various adjustable frames that can telescope or otherwise expand in some manner in both dimensions toward or at the corners; this approach allows the fabric to be seized to the frame as a separate operation that can be completed prior to stretching. In some systems the tension can be released at a later time but demounting and remounting the fabric generally incur difficulties that range from problematic to impossible.

Typically known methods of gripping fail to adequately accommodate two dimensional stretching, fail to permit ready removal/remounting of the canvas, and/or fail to allow a removed canvas to be easily rolled up for shipping or storing purposes and then later re-mounted.

DISCUSSION OF RELATED KNOWN ART

U.S. Pat. No. 5,113,611 discloses an expandable screen tensioning frame with expansion devices including telescoping corners, and provides descriptions of seventeen prior art patents directed to apparatus and methods for stretching fabrics.

U.S. Pat. No. 5,517,775 discloses a plastic edging strip that can be bent into a circle or around corners and is reinforced by thrust support brackets: fastening is by staples or other permanent fastenings into a solid wood frame or backboard. With no special provision for the two-dimensional stretching problem of corner wrinkles, this approach is shown as directed mainly to circular mounting frames which are inherently less prone to such problems.

Generally the above approaches and other that have been suggested for stretching canvas or other fabric material over a frame provide only for permanent attachment, and thus fail to provide capability of convenient subsequent removal from the frame at a future time.

OBJECTS OF THE INVENTION

It is a primary object of the present invention to provide an improved method and structure for two-dimensional stretching of material or fabric such as art canvas, particularly with regard to the manner of gripping the material for stretching.

It is a further object to provide an improved method and structure for gripping fabric such as art canvas for the purpose of mounting it stretched around the perimeter of a mounting frame in a manner that will, at a later time, permit convenient removal of the fabric from the frame as well as satisfactory subsequent remounting onto the frame.

It is a still further object that the system of gripping should allow the fabric, including artwork, to be readily removed from a frame and rolled up for shipping or storage and then later remounted and stretched onto the frame.

It is a further object that with canvas that has been processed, stretched and seasoned on a frame, that the system of the invention enable removal and remounting with accurate registration around the frame on the original fold lines.

SUMMARY OF THE INVENTION

The abovementioned objects have been accomplished by the present invention of a system of specially shaped gripping members that are attached to the material in a row along each edge in a manner that in co-operative engagement with the frame, accommodates two-dimensional stretching and also facilitates future dismounting of the material from the frame, rolling up for shipping or storage, and reassembly and re-stretching onto the frame.

The gripping members slide into the frame channels, the frame channels engage a mounting frame, then the fabric is stretched by expanding the frame. The members are made to slide freely in the frame channels and are spaced apart in a compliant manner that fully accommodates two-dimensional stretching of the fabric.

Openings may be provided in the frame channels to provide access to the members if necessary for optimizing the stretching operation.

The frame may be later adjusted to release the stretching forces and to enable the fabric, along with the gripping members, to be removed from the frame channels.

In a preferred embodiment, specially shaped individual gripping members are attached in pairs opposite each other on both sides of the fabric, and such pairs are arranged in a straight row near the edge of the fabric and permanently attached to each other through the fabric by fastenings such as wire staples or by hand or machine stitching.

In another embodiment a row of gripping members is formed in an automated process, joined together by curved flexible strips that allow longitudinal expansion and contraction to accommodate two-dimensional fabric stretching and that automatically set the spacing of the members.

In any embodiment, the gripping members are shaped and spaced apart in an optimal manner: close enough together to provide efficient gripping and yet far enough apart for the fabric to be rolled for transportation and shipping purposes, and then later re-stretched onto the frame.

Particular embodiments are disclosed with capability of mounting and stretching fabric around the perimeter of a fixed mounting frame.

BRIEF DESCRIPTION OF THE DRAWINGS

The above and further objects, features and advantages of the present invention will be more fully understood from the following description taken with the accompanying drawings in which:

FIG. 8 is a perspective view of an alternative approach for automation wherein the gripping members are flexible joined together in a continuous expandable strip.

FIG. 9 is a three-dimensional cutaway view of a portion of a canvas stretch-mounting system as in FIG. 4 showing a frame channel, keyed to a frame rail, containing a row of gripping members attached to the fabric.

DETAILED DESCRIPTION

Figure 1:
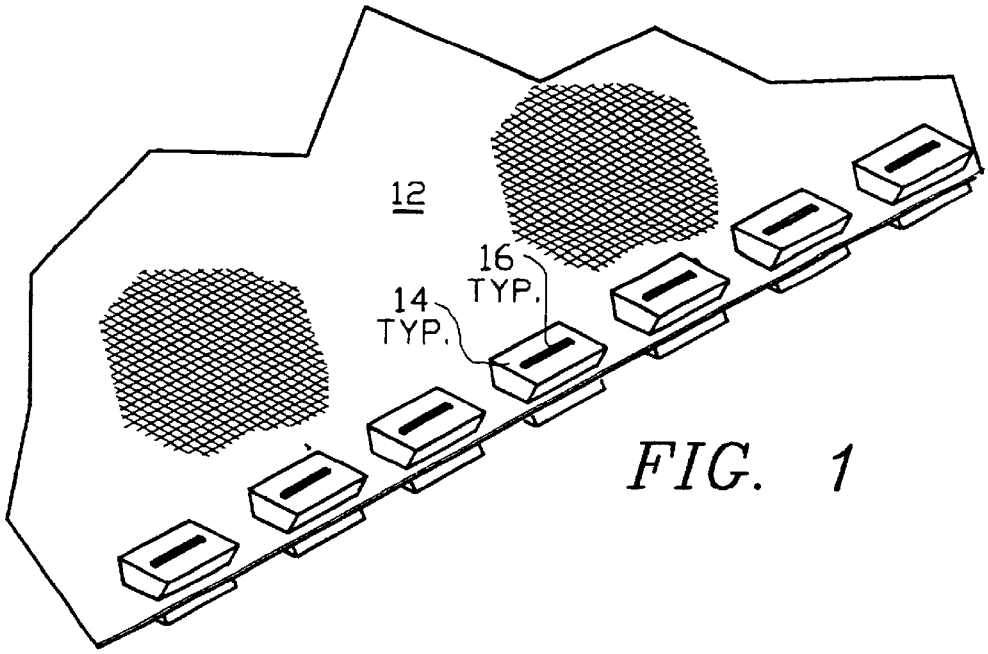
FIG. 1 is a perspective view of an edge region of a canvas fitted with gripping members according to the present invention.

FIG. 1, a perspective view of an edge region of a canvas 12 fitted with a row of gripping members 14 arranged in pairs, one on each side of canvas 12 and each pair secured to each other by a staple 16 through the canvas 12, so as be engagable with a frame channel in a preferred embodiment of the present invention.

Figure 2:
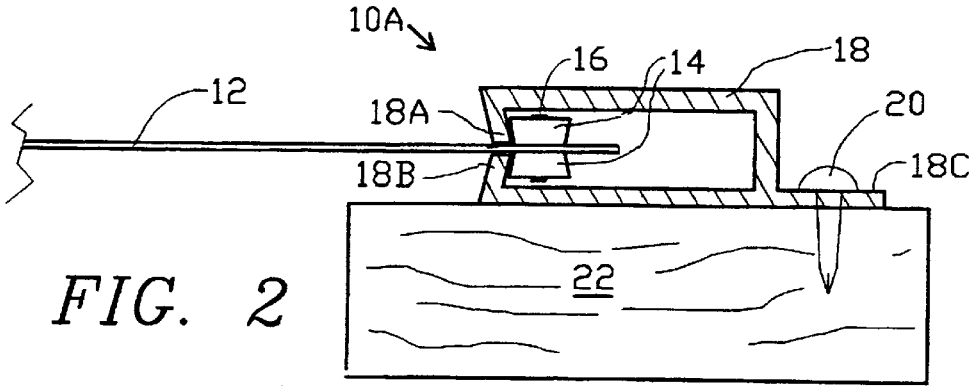
FIG. 2 shows an end view of a basic gripping system consisting of a frame channel of the present invention engaging gripping members of FIG. 1 and attached to a stretching frame rail in a system for pre-stretching fabric.

FIG. 2, an end view of a fabric gripping system 10A in a basic embodiment of the present invention, shows an edge region of canvas 12 as in FIG. 1 fitted with a pair of gripping members 14, one on each side of the canvas 12, held together by a wire staple 16. The gripping members 14 are captivated inside frame channel 18, typically an aluminum extrusion having the cross-sectional shape shown, with the canvas 12 passing through a gap that is formed between a pair of flanges 18A and 18B, one on each side of canvas 12. Flanges 18A and 18B are angled inwardly at center as shown, at an inclination that corresponds to the adjacent inclined sides of gripping members 14: this inclined plane effect acts in a manner to urge the two flanges 18A and 18B inwardly against each other whenever the canvas 12 is held under stretching tension: this avoids any tendency for the flanges 18A and 18B to spread apart and widen the gap under stretching tension, which could ultimately lead to fabric failure.

Frame channel 18 is seen to have an extending mounting flange 18C by which it may be fastened by a set of screws 20 to a rail 22, which may be part of an expandable pre-stretching frame, a backboard, or a structural member that is adjustably attached to solid building structure such as a floor.

Figure 3:
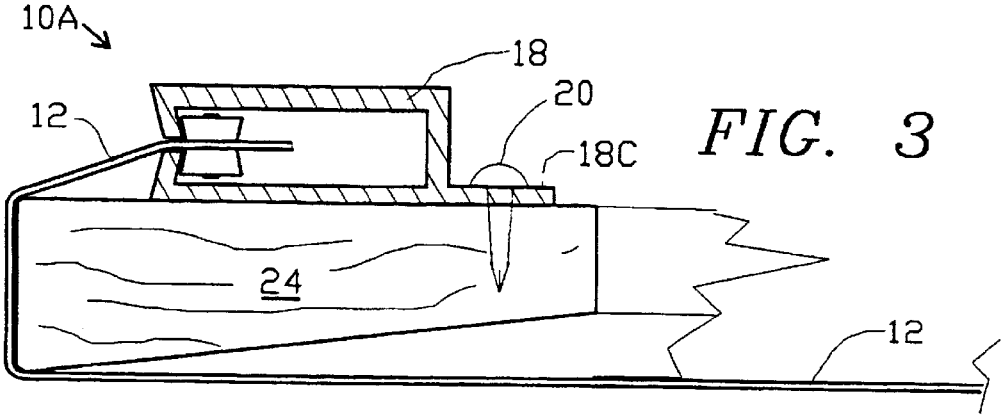
FIG. 3 depicts the gripping system of FIG. 2 deployed on an expandable mounting frame rail and shown holding a canvas stretched and wrapped around the perimeter.

FIG. 3 depicts the gripping system 10A of FIG. 1 deployed on a mounting frame 24 around which the canvas 12 is wrapped and to which frame channel 18 is fastened by a set of screws 20. Rail 24 is part of a conventional artwork mounting frame; the front face of rail 24 is tapered inwardly from the perimeter edge as shown to stay clear of the canvas 12.

If the mounting frame containing rail 24 is the expandable type, then frame channel 18 may be securely fastened in a fixed location on the rail 24, with screws 20 passing through round clearance holes in frame channel 12 thence into the wooden rail 24 as shown.

If the mounting frame containing rail 24 is the fixed type, then the screw clearance holes in frame channel 12 may be made elongated to form a slot so as to provide frame channel 12 with a range of travel across rail 24 and thus provide capability of adjustably stretching the canvas 12.

Figure 4:
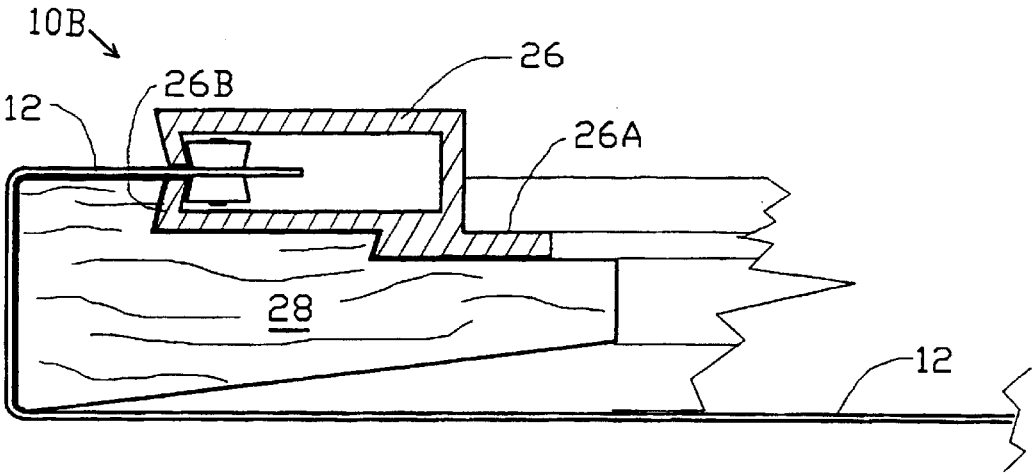
FIG. 4 depicts a canvas stretch-mounting system similar to that of FIG. 3 but utilizing an alternative extruded frame channel that engages a specially shaped mounting frame that requires no mounting hardware.

FIG. 4 depicts a canvas stretch-mounting system 10B similar to that of FIG. 3 but utilizing an alternative extruded frame channel 26 that is configured at the bottom with a stepped anchoring flange 26A shaped as shown and engaging a mating anchoring step configured in the specially shaped rail 28 of an expandable mounting frame. Further anchoring is provided by flange 26B of frame channel 26 engaging a mating step formed at that region of rail 28. This inclined plane double-anchoring system locks under stretching tension and eliminates the need for any screws or other mounting hardware to fasten the frame channel 26 to the rail 28.

Figure 5:
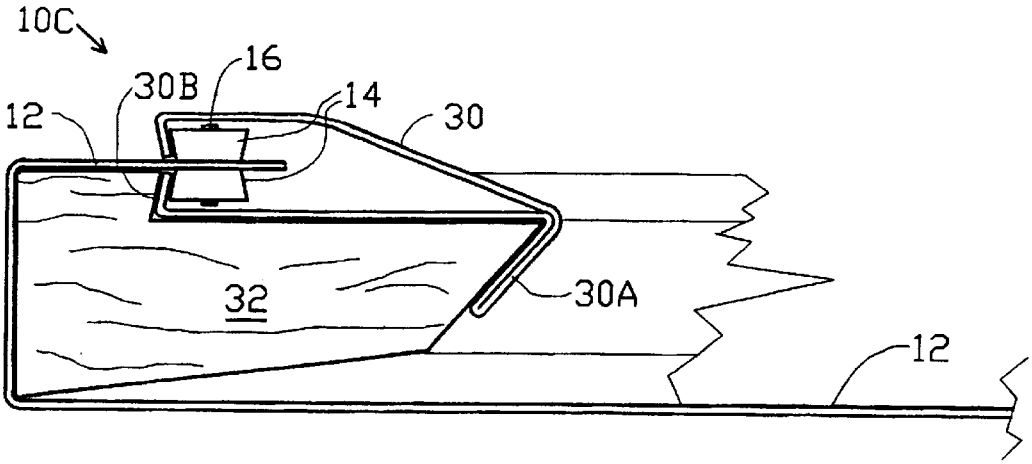
FIG. 5 depicts a canvas stretch-mounting system similar to that of FIG. 4 but utilizing an alternative formed sheet metal frame channel.

FIG. 5 depicts a canvas stretch-mounting system 10C similar to that of FIG. 4 but utilizing an alternative version of frame channel 30 that can be formed from sheet metal. An angled flange 30A engages the similarly angled inner edge of rail 32 of an adjustable mounting frame. Rail 32 has only a single angled step at the rear that engages flange 30B of frame channel 30. As in FIG. 4 this double-anchor system is self-locking when under stretching tension and thus requires no mounting hardware.

Figure 6A:
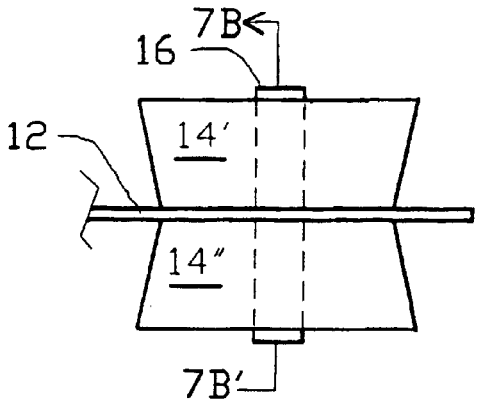
FIG. 6A is an enlarged side view of a pair of gripping members shown in FIGS. 1–5, secured together onto the fabric by a metal staple.
Figure 6B:
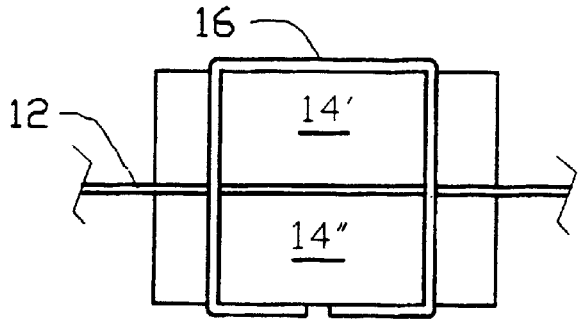
FIG. 6B is a cross-sectional view through 6B–6B' of FIG. 6A showing the crimped staple driven through the gripping member.

FIG. 6A is an enlarged side view of a pair of gripping members 14, as shown in FIGS. 1–5, secured together onto the fabric 12 by a metal staple 16 driven downwardly through the upper member 14', through the fabric 12 and though the lower member 14", where the staple 16 is crimped at the bottom side, as shown in FIG. 6B, which is a cross-sectional view through 6B–6B' of FIG. 6A.

Gripping members 14 are made from compliant material such as vinyl that can be stapled without requiring predrilled holes. The members 14 can be cut with the required edge angles from a continuous strip of vinyl material.

Figure 7A:
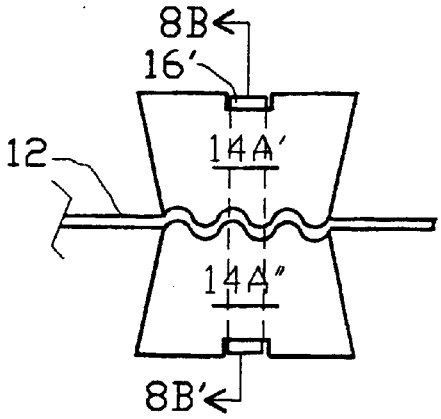
FIG. 7A is an enlarged side view of an alternative form of gripping member with a serrated material-gripping surface.

FIG. 7A is an enlarged side view of an alternative form of gripping member 14A configured with a serrated surface to go against the fabric 12, for particular type of fabric that may be more difficult to grip. The upper members 14A' and the lower members 14" are identical but need to be oriented correctly relative to each other so that the serrations mate together as shown. For manufacturing purposes, a color code of other marking on one end of members 14A can facilitate this complementary matching orientation.

Figure 7B:
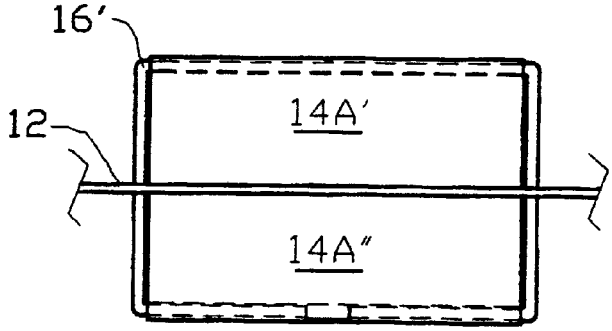
FIG. 7B is a cross-sectional view through 7B–7B' of FIG. 7A showing the crimped staple, flanking the gripping member.

In FIG. 7B, a cross-sectional view through 7B–7B' of FIG. 8A, the staple 16' is seen flanking the gripping members 14A (rather than being forced through as in FIG. 6B), and it is retained in a recessed manner by a groove configured in the major surface, e.g. at the top of gripping member 14A', as shown. Alternately two retaining grooves could be provided, one at each end of member 14A; or three grooves could be provided, one on each of the three sides of the gripping member that are adjacent to staple 16'.

FIG. 8 is a perspective view of an alternative approach, suitable for automation, wherein the gripping members 14B are flexibly joined together in a continuous strip by a pair of arched runners 14C extending between each adjacent pair of members 14B as shown. In a manner similar to that described above in connection with gripping members that are deployed individually, gripping members 14B in strip form are attached on both opposite sides of the fabric along the edge, where they are secured either by hand or machine stitching with strong thread or by stapling as described above for individual gripping members, using hand-held stapling guns or a larger stapling machine.

When gripping members 14B are fastened in place on both sides of the fabric, they are assembled into a frame channel, which can be any of the types described above and attached to a corresponding mounting frame rail as described.

The continuous strip of gripping members 14B may be molded from suitable plastic material or otherwise fabricated from suitable material.

Each member 14B has a central opening and a longitudinal groove provided to accept stitching by machine or hand as the method of securing opposite members 40 together in a pair with the canvas 12 sandwiched between.

The arched shape of flexible runners 14C running between gripping members 14B allows the continuous strip to expand or contact and thus serves two purposes: 1) it allows the gripping members 14B to expand as required when the fabric is being stretched, and 2) when the fabric is dismounted, they allow it to be rolled in a coil without damage for shipping, etc., by expanding on one side and contracting on the other side as required.

In the stretching process it may be desirable to "fine tune" the uniformity of the material stretching, by shifting individual gripping members 14B along the direction of the fabric edge as the stretching force is being increased. For this purpose, in any embodiment of the invention, the gripping members 14 or 14B may be configured with lateral slot across the top as shown in FIG. 8 or equivalent, by which they can be engaged and shifted within the frame channel.

FIG. 9 is a three-dimensional cutaway view of the rear side of a portion of a canvas stretch-mounting system 10B as in FIG. 4, shown cut off square at the left hand side. Frame channel 26 contains a row of gripping members 14 attached to the fabric 12 which is wrapped around the special wood frame rail 28 into which frame channel 26 is keyed as described above in connection with FIG. 4. Frame channel 26 is configured with an array of elongated access slots 26C along the rear side for the purpose of enabling individual gripping members 14 to be engaged and shifted as required.

While the foregoing descriptions have shown the invention in connection with canvas, it can be practiced with practically any type of fabric and even with other sheet materials such as plastic and random fibre sheets.

This invention may be embodied and practices in other specific forms without departing from the spirit and essential characteristics thereof. The present embodiments therefore are considered in all respects as illustrative and not restrictive. The scope of the invention is indicated by the appended claims rather than by the foregoing description. All variations, substitutions, and changes that come within the meaning and range of equivalency of the claims therefore are intended to be embraced therein.

What is claimed is:

1. A fabric-gripping system, for stretching fabric material, including in particular art canvas, in two mutually perpendicular directions in a flat plane, the fabric material having four edges as defined by a rectangular mounting frame, comprising:

a plurality of like gripping members arranged in at least three pairs that are disposed uniformly spaced apart in a line along each of the four edges of the fabric material, the line being near and substantially parallel to a corresponding edge, each member having a gripping surface interfacing a corresponding gripping region of the fabric material, shared by a counterpart member disposed in mirror-image relationship on the opposite side of the fabric material;

member attachment means, for retaining the two members of each pair secured together, sandwiching the fabric material in the corresponding gripping region, said member attachment means being deployed in a manner to penetrate through the fabric material within the gripping regions and through openings configured in said members and to thus secure the two members of each pair together, seized against opposite sides of the fabric material;

a plurality of frame channels made and arranged to enclose the gripping members in a manner that constrains the members laterally with relative freedom to move longitudinally relative to each frame channel, while providing a longitudinal gap through which the fabric material extends from within said frame channels in a manner to be disposed in the flat plane and placed under tension; and channel-to-frame engagement means for providing engagement between said frame channels and the frame in a manner to enable setting up and sustaining stretching tension in the fabric material in the two mutually perpendicular directions.

2. The fabric-gripping system as defined in claim 1 wherein said frame channels and said flat plane of the fabric material are both disposed on one and the same side of the frame, the frame channels being disposed with the gaps facing inwardly away from outer edges of the frame.

3. The fabric-gripping system as defined in claim 1 wherein said frame channels and said flat plane of the fabric material are disposed on opposite sides of the frame with the fabric material wrapped around outer edges of the frame, the frame channels being disposed with the gaps facing outwardly toward the outer edges of the frame.

4. The fabric-gripping system as defined in claim 1 wherein said pairs of gripping members are spaced far enough apart that fabric material fitted with the gripping members but not installed in said frame channels can be readily coiled into a roll for storing and shipping purposes.

5. The fabric-gripping system as defined in claim 1 wherein:

said frame channels are configured with inside wall regions, flanking the gap and engaging said gripping members, that incline symmetrically toward the interior of the frame channels, and said gripping members are configured to provide a bearing surface that is inclined and arranged to mate with said frame channel adjacent the gap, thus forming an inclined plane system that acts to prevent said frame channel from deforming in a manner and direction that could spread and open the gap from tensional stress set up in the fabric material.

6. The fabric-gripping system as defined in claim 1, wherein said member attachment means comprises heavy duty thread, stitched in place.

7. The fabric-gripping system as defined in claim 1 wherein said member attachment means comprises a metal staple extending through the fabric material, secured in place in by bending the ends in a conventional manner of stapling so as to hold each pair of gripping members together in place on opposite sides of the fabric material.

8. The fabric-gripping system as defined in claim 7 wherein each of the gripping members is configured with recessed grooves on at least one side thereof for recessing and retaining said metal staple.

9. The fabric-gripping system as defined in claim 7 wherein each of the gripping members is configured with a pair of through openings made and arranged to accept insertion of said metal staple through both of a pair of members for retention thereof.

10. The fabric-gripping system as defined in claim 1 wherein each of said gripping members is configured symmetrically such that either of two opposite sides are inclined in mirror image fashion so that each member can be deployed in either of two orientations 180 degrees apart.

11. The fabric-gripping system as defined in claim 1 wherein the frame is rectangular and made to be adjustable in width and length for purposes of setting up and adjusting tension in the fabric material.

12. The fabric-gripping system as defined in claim 11 wherein said channel-to-frame engagement means comprises at least one step configured in the frame engaging a mating step configured in each of said frame channels, the steps being formed to incline in a manner to anchor said frame channels from shifting relative to the frame when the fabric material is placed under tension, and yet allow free separation of the frame channels from the frame by a sufficient reduction in size of the adjustable frame.

13. The fabric-gripping system as defined in claim 11 wherein said channel-to-frame engagement means comprises an anchor flange formed along each of said frame channels on an edge thereof opposite the gap, made an arranged to engage an edge of the frame, said anchor flange and edge of the frame being formed to incline in a manner to anchor said frame channels from shifting relative to the frame when the fabric material is placed under tension.

14. The fabric-gripping system as defined in claim 1 wherein said frame is rectangular and fixed in size and wherein said channel-to-frame engagement means comprises:

a fastening flange extending from each of said frame channels on an edge thereof opposite the gap, made an arranged to provide and extension interfacing the frame and configured with mounting screw holes; and a plurality of mounting screws deployed through the screw holes and engaging the frame;

whereby said frame channels are fastened and prevented from shifting relative to the frame when the fabric material is placed under tension.

15. The fabric-gripping system as defined in claim 1 wherein said frame channels are configured with series of access slots, located on an exposed side thereof, dimensioned and arranged to provide access to said gripping members so as to facilitate longitudinal shifting of said gripping members for purposes of adjusting for uniform distribution of tensional stress in the fabric material.

16. The fabric-gripping system as defined in claim 1 wherein said gripping members are configured with an undulating pattern on the gripping surface thereof, with ridges and valleys formed and arranged to enhance gripping on the fabric material.

17. A method of edge-gripping and frame-mounting fabric material, including in particular art canvas, that provides uniform stretching in two dimensions and that enables easy demounting and rolling of the fabric material for purposes of storage and shipping, comprising the steps of:

(1) attaching a plurality of like gripping members arranged in pairs disposed uniformly spaced apart in a line along edges of the fabric material, the line being near and substantially parallel to a corresponding edge, each member having a gripping surface interfacing a corresponding gripping region of the fabric material, shared by a counterpart member disposed in mirror-image relationship on the opposite side of the fabric material;

(2) inserting the gripping members into a plurality of frame channels made and arranged to enclose the gripping members in a manner that constrains the members laterally with relative freedom to move longitudinally relative to each frame, while providing a longitudinal gap through which the fabric material extends from within said frame channels in a manner to be disposed in the flat plane and placed under tension; and (3) engaging said frame channels to the frame with channel-to-frame engagement means made and arranged to enable setting up and sustaining tension in the fabric material.

* * * * *